United States Patent [19]

Vanotti

[11] Patent Number: 4,927,078

[45] Date of Patent: May 22, 1990

[54] DEVICE FOR ELASTICALLY AND RAPIDLY FIXING A RAILWAY RAIL

[75] Inventor: Gerard Vanotti, Maillat, France

[73] Assignee: Etablissements S.A., Oyonnax, France

[21] Appl. No.: 246,816

[22] PCT Filed: Dec. 11, 1987

[86] PCT No.: PCT/FR87/00493

§ 371 Date: Jul. 29, 1988

§ 102(e) Date: Jul. 29, 1988

[87] PCT Pub. No.: WO88/04342

PCT Pub. Date: Jun. 26, 1988

[30] Foreign Application Priority Data

Dec. 12, 1986 [FR] France ..... 86-17614

[51] Int. Cl.[5] ..... E01B 9/48; E01B 9/60

[52] U.S. Cl. ..... 238/349; 238/353; 238/355

[58] Field of Search ..... 238/310, 315, 338, 343, 238/345, 347, 353, 354, 355, 356, 357, 361, 364, 366, 370, 371, 377, 341, 349, 352, 297

[56] References Cited

U.S. PATENT DOCUMENTS

| | | | |
|---|---|---|---|
| 877,328 | 1/1908 | Grandy | 238/374 |
| 2,258,315 | 10/1941 | Boyce | 238/349 |
| 2,294,736 | 9/1942 | Burckhardt | 238/349 |
| 2,357,629 | 9/1944 | Cantrell et al. | 238/349 |
| 3,282,506 | 11/1966 | Holstein | 238/349 |
| 3,309,023 | 3/1967 | Burwell | 238/349 |
| 4,066,212 | 1/1978 | Sonneville | 238/349 |

FOREIGN PATENT DOCUMENTS

| | | | |
|---|---|---|---|
| 1040582 | 10/1958 | Fed. Rep. of Germany | 238/377 |
| 2806817 | 3/1979 | Fed. Rep. of Germany | 238/349 |
| 2810618 | 9/1979 | Fed. Rep. of Germany | 238/349 |
| 3512200 | 10/1986 | Fed. Rep. of Germany | 238/349 |
| 0075438 | 5/1961 | France | 238/377 |
| 0988860 | 8/1961 | United Kingdom | 238/349 |
| 0959113 | 5/1964 | United Kingdom . | |
| 1158060 | 7/1969 | United Kingdom | 238/349 |
| 2045320 | 10/1980 | United Kingdom | 238/349 |

*Primary Examiner*—Andres Kashnikow
*Assistant Examiner*—Timothy Newholm
*Attorney, Agent, or Firm*—Sandler, Greenblum & Bernstein

[57] ABSTRACT

A securing device for a railway rail includes a fixing rod having a first end in the form of a spring head which bears on the shoe of the rail. The rod extends through a shim and has a second end is configured like a hook and is held in an anchoring sheath embedded in a support. The anchoring sheath includes a shoulder for tensioning the spring head under the shoe of the rail after the rod has been rotated by a half turn. The tensioning of the rod also results from the slope of the upper surface of the shim which extends upwardly and continues the slope of the shoe of the rail.

16 Claims, 4 Drawing Sheets

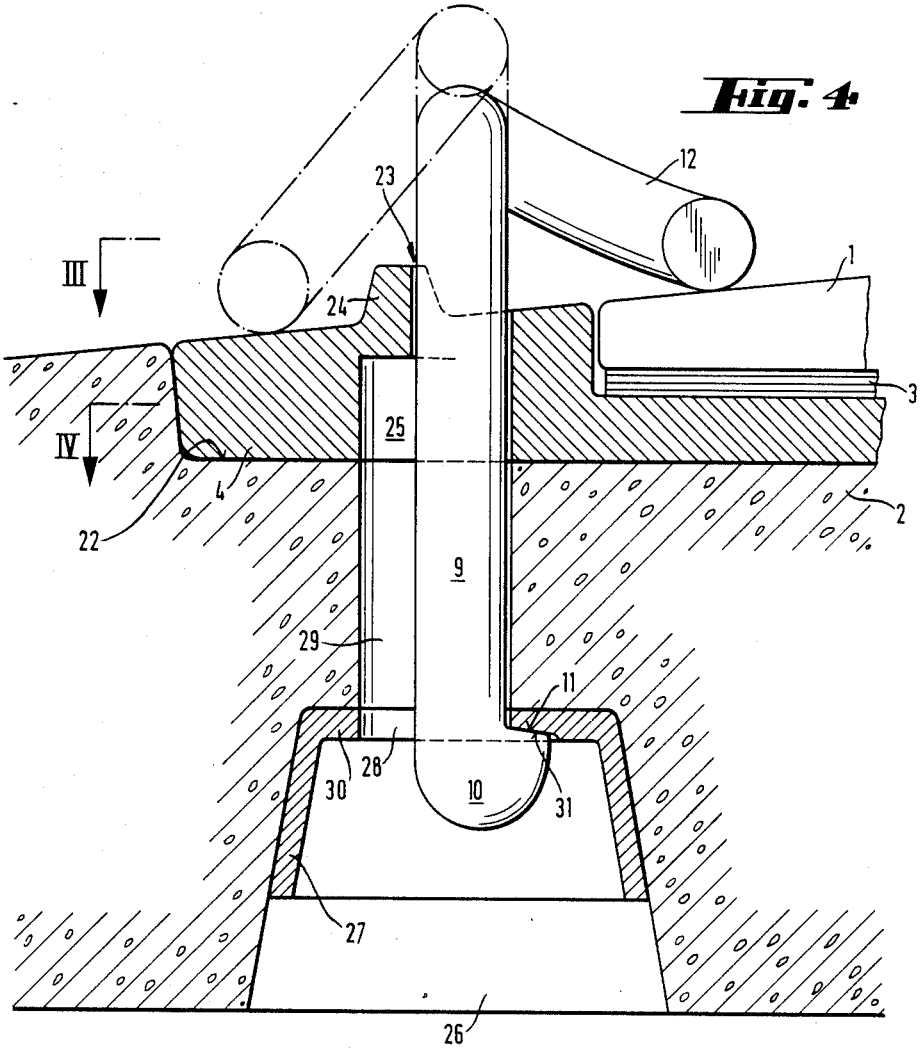
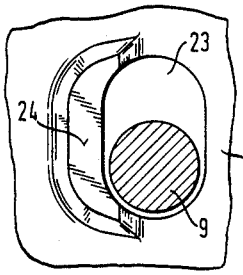
Fig. 5
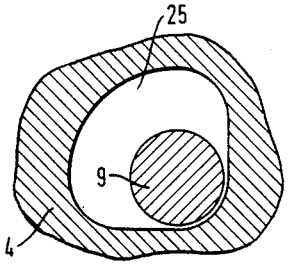
Fig. 6

DEVICE FOR ELASTICALLY AND RAPIDLY FIXING A RAILWAY RAIL

The present invention has as an object an apparatus for rapid elastic attachment of a railroad rail on cross-ties, of cement, wood, plastic material, of the type comprising a rod whose spring head in the form of an open ring rests on the shoe of the rail, furthermore centered on its support by a shim or tie plate, while its other end comprises a hooking means associated with the cross-tie making it possible to tension the spring head on the shoe of the rail after the rod has been moved a half-turn.

British Patent Nos. 2,045,320 and 959,113 describe elastic attachment devices for a railroad rail of the type mentioned above. These devices comprise only a single means for tensioning the spring head on the shoe of the rail, constituted by a hook cooperating with the edge of a retension element included in the cross-tie, which appears insufficient for an effective attachment anchoring.

On the contrary, an object of the present invention is to provide a device having two associated means for progressively tensioning the spring head of the attachment rod of the rail.

The first means consists in the difference of level which results from the slope which affects the upper surface of the shim, or the centering tie plate of the rail and which extends the slope from its shoe such that by maneuvering the attachment rod by a half-turn, one brings its head from a low position to a higher position, exerting a high tension on the flange of the said rail.

The second means consists of a cam formed by the internal shoulder reserved in an insulating anchoring sheath of the "PLASTIRAIL" type inserted in the cross-tie and to which is hooked the free end of the attachment rod of the rail after it has been turned by a half-turn, the shoulder resulting from two successive bores hollowed out of the sheath.

According to another embodiment of the invention, the second tensioning means of the spring rod consists of a steel container included in a facing provided in the cement or wood cross-tie, at right angles with a bore hollowed out of the said cross-tie, to which corresponds an opening provided in the centering tie plate of the rail on the shoe of which is supported the head of the spring rod placed in tension, after it has been turned by a half-turn, by hooking of its projecting heel to an internal edge which the bottom of the container bored with an orifice corresponding to the cross-section of the spring rod reserves.

According to another embodiment of the apparatus, the second tensioning means of the spring rod consists of a shoulder resulting from the difference in diameters of two bores hollowed in the centering tie-plate of the rail fixed by sleeper-screws if it rest on a wood cross-tie, or by insulating anchoring sheaths of the type known under the mark "PLASTIRAIL" if it rests on a cement cross-tie, the shoulder allowing for the hooking of the eccentric heel of the spring head after it has been turned by a half-turn, a shim immobilizing the said spring rod in the tightening position on the shoe of the rail.

The tensioning means of the spring head, whether it is the shoulder reserved in the anchoring sheath, or the internal edge formed by the container or of the shoulder reserved in the tie plate, are hollowed out of a depression which serves as an anti-return abutment in which is engaged the heel of the spring rod.

The centering shim of the rail comprises an opening adapted to the sections of the spring rod and its heel and offset with respect to the bore of the anchoring sheath for blocking it in part when the spring rod is introduced therein, while one of its surfaces, resting against the lateral wall of the housing reserved in the cross-tie, is opened out to assure a slight pinching resulting from the lateral forces exerted by the spring rod, when it is tensioned, against a small flange capping the shim.

The details of this apparatus will be better understood from the description which follows with reference to the annexed drawings showing several examples of the embodiments.

FIG. 4 is a longitudinal cross-section view of the attachment apparatus of a rail on a cement or wood cross-tie, equipped with a centering tie plate of the rail.

FIG. 5 is a transverse cross-sectional view at the level III—III of FIG. 4.

FIG. 6 is a second view in transverse cross-section at the level IV—IV of FIG. 4.

Figure 1:
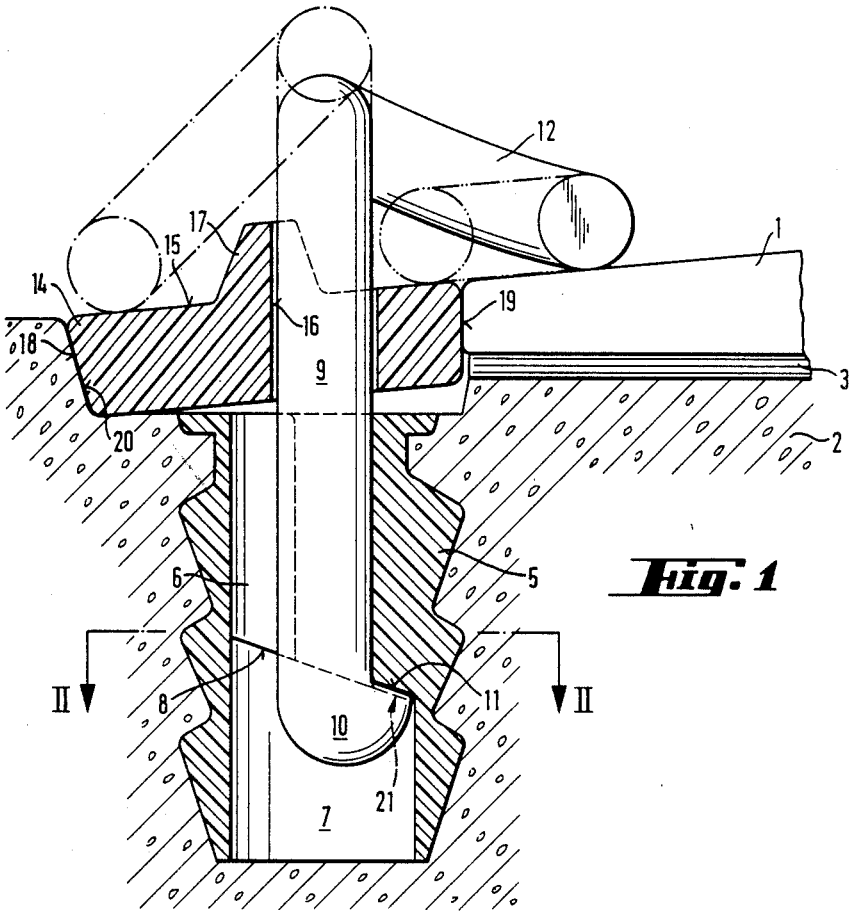
FIG. 1 is a longitudinal cross-sectional view of the attachment apparatus of a rail on a cement cross-tie.

In the drawings, reference 1 designates the shoe of a railroad rail resting on a cross-tie of cement, or wood 2 by means of an elastic sole 3, or resting on a metallic or reinforced plastic material tie plate 4 in the known manner.

Figure 2:
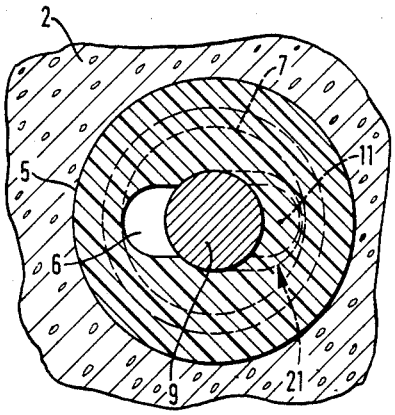
FIG. 2 is a transverse cross-sectional view at the level II—II of FIG. 1.
Figure 3:
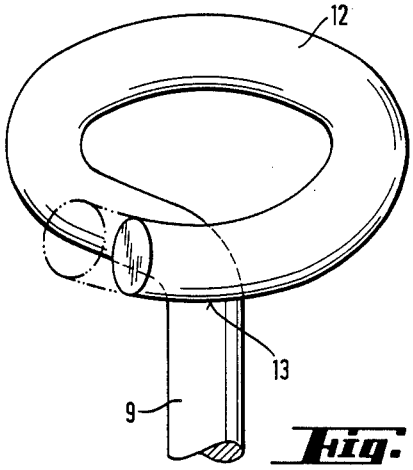
FIG. 3 is a detailed elevational view of the spring rod head of the apparatus.

FIGS. 1–3 illustrate a first embodiment of the attachment apparatus of the rail being discussed.

An insulating anchorage sheath 5 made of plastic material of the type known by the mark "PLASTIRAIL" is inserted in the cross-beam 2 made of cement at the time it is molded.

This sheath comprises a first bore 6 of oblong cross-section as is seen in FIG. 2, preceding a second bore 7 of circular cross-section. From the difference in cross-section of these two bores results a shoulder 8 which can have a descending slope directed towards the interior, i.e., towards the median portion of the cross-beam 2, to serve the role of a cam. As FIG. 2 illustrates, a portion of the oblong cross-section of the bore 6 is hammered out to form two abutments which exist over the entire height of the bore.

The attachment apparatus of the rail consists, according to the invention, of a spring rod 9 made out of steel wire, or reinforced plastic. At its lower end, this rod comprises an eccentric heel 10 having a rounded end forming a hook 11 adapted to cooperate with shoulder 8 of insulating sheath 5. The cross-section of the hooked portion 11 of the heel is slightly lower than the rod itself to allow for its passage in the bore 6 of the anchoring sheath 5. The rod 9 forms, at its other end, an open ring 12 extending laterally at an acute angle as is illustrated in FIGS. 1 and 3. This ring 12 constitutes the spring head of rod 9 and can comprise a flat support portion 13 on the shoe 1 of the rail.

The apparatus is completed by a centering and maintenance shim 14 of rail 1. It is an element of metal or plastic material having a rectangular shape whose upper surface 15 has a slight slope extending that of the shoe of rail 1. This shim 14 is bored by an orifice of oblong cross-section 16 capped by a small support flange 17 of spring head 9. When shim 14 is in the position of FIG. 1, its orifice 16 is offset with respect to the bore 6 of sheath 5, which causes its partial blocking.

One of the two lateral sides of shim 14 widens out upwardly, particularly the side 18 in contact with wall 20 of the opening extending through cross-beam 2. The other side 19 abuts against the lateral slice of the shoe of rail 1. These details are visible in FIG. 1 of the drawings and they lead to a good centering of rail 1.

The anchoring sheath 5 is correctly positioned during molding of the cement cross-beam 2, the shoulder 8 forming a cam directed towards the shoe of rail 1, as seen in FIG. 1.

The centering shim 14 and spring rod 9 on which it is first engaged, constitute thus a movable assembly in two elements.

The spring rod 9 of this assembly is introduced by its heel 10, in a manual or automatic fashion, in the bore 6 of the anchoring sheath 5 along the position shown in dashed lines in FIG. 1, the head 12 being positioned on the centering shim 14 which has been mechanically adjusted in its seat of cross-tie 2.

In the tightening position which the spring rod 9 assumes in FIG. 1, the hooking surface 11 of its heel 10 abuts against the two edges 21 of a depression hollowed out of the shoulder surface 8 of sheath 5 and serves the role of anti-return abutments.

Furthermore, one observes FIG. 1 that the free end, shown in dashed lines, of ring 12 constituting the tightening head of shoe 1 of the rail, can extend on the centering shim 14 to stop it from escaping outside of its seat under the action of the lateral force which is exerted by spring 9 against semi-collar 17 of shim 14.

According to the embodiment shown in FIGS. 4, 5 and 6, rail 1 rests on the centering tie plate 4 by means of the elastic sole 3. In the known manner, this tie plate 4 is included in a seat 22 of the cement or wood cross-tie 2. The ends of tie plate 4 are bored with a first orifice 23 of oblong cross-section surrounded by a small flange 24, opening into a second orifice 25 having a sectorial shape as is shown by FIG. 6 to allow for the introduction of the spring rod 9.

In a facing 26, extending through the cross-tie of wood, or cement 2, is retained a steel container 27 having a wall widening out downwardly whose bottom, bored with an orifice 28 of cross-section corresponding to a bore 29 of cross-tie extending vertically the orifice 25 of tie plate 4, reserves an edge 30 hollowed out of a depression 31 which cooperates with surface 11 of heel 10 of spring rod 9.

Figure 7:
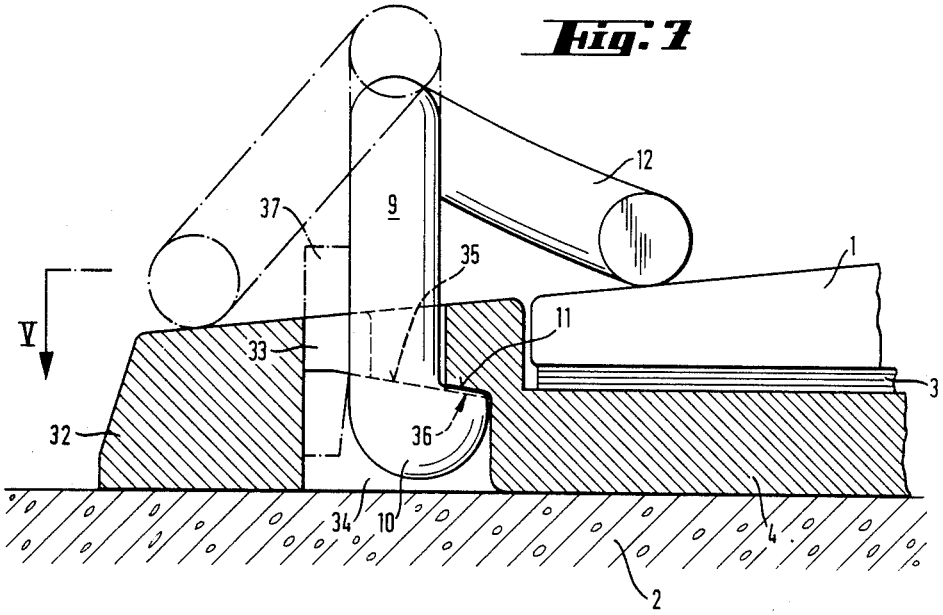
FIG. 7 is a longitudinal cross-sectional view of the attachment apparatus of a rail on a cement or wood cross-tie, equipped with a tie plate attached by traditional means.

According to the embodiment shown in FIG. 7, rail 1 rests also on a tie plate 4, furthermore affixed to the wood or cement cross-tie 2 by means of sleeper-screws, or insulating anchoring sheaths known under the mark "PLASTIRAIL".

Figure 8:
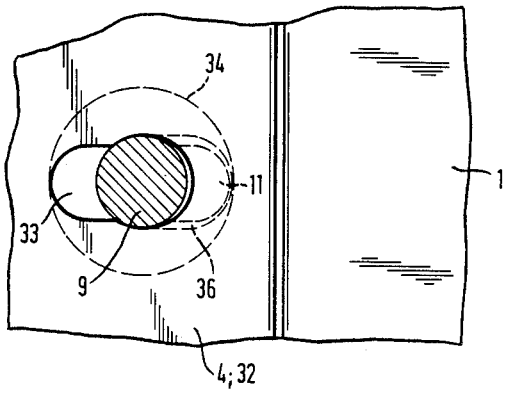
FIG. 8 is a transverse cross-sectional view at the level V—V of FIG. 7.

This tie plate 4 made out of metal or plastic material, comprises, at its projecting ends 32, the tensioning means of spring 9. To this end, portion 32 is bored with a first orifice 33 of oblong cross-section allowing for the introduction of rod 9 and preceding a second orifice 34 of circular cross-section. The difference in diameters of the orifices 33 and 34 results in a shoulder which can have a descending slope 35 directed towards shoe 1 of the rail. This shoulder comprises a depression whose edges 36 serve as anti-return abutments of heel 10 of the spring rod. In the tightened position shown in FIG. 7, a shim 37 can be introduced into orifice 33 of tie plate 4 to immobilize the spring rod 9. However, the shim is not necessary if a portion of the bore 33 is hammered out as shown in FIG. 8, to form two abutments which continue over the entire height of the bore and prevent a flexion of the spring rod 9.

Figure 9:
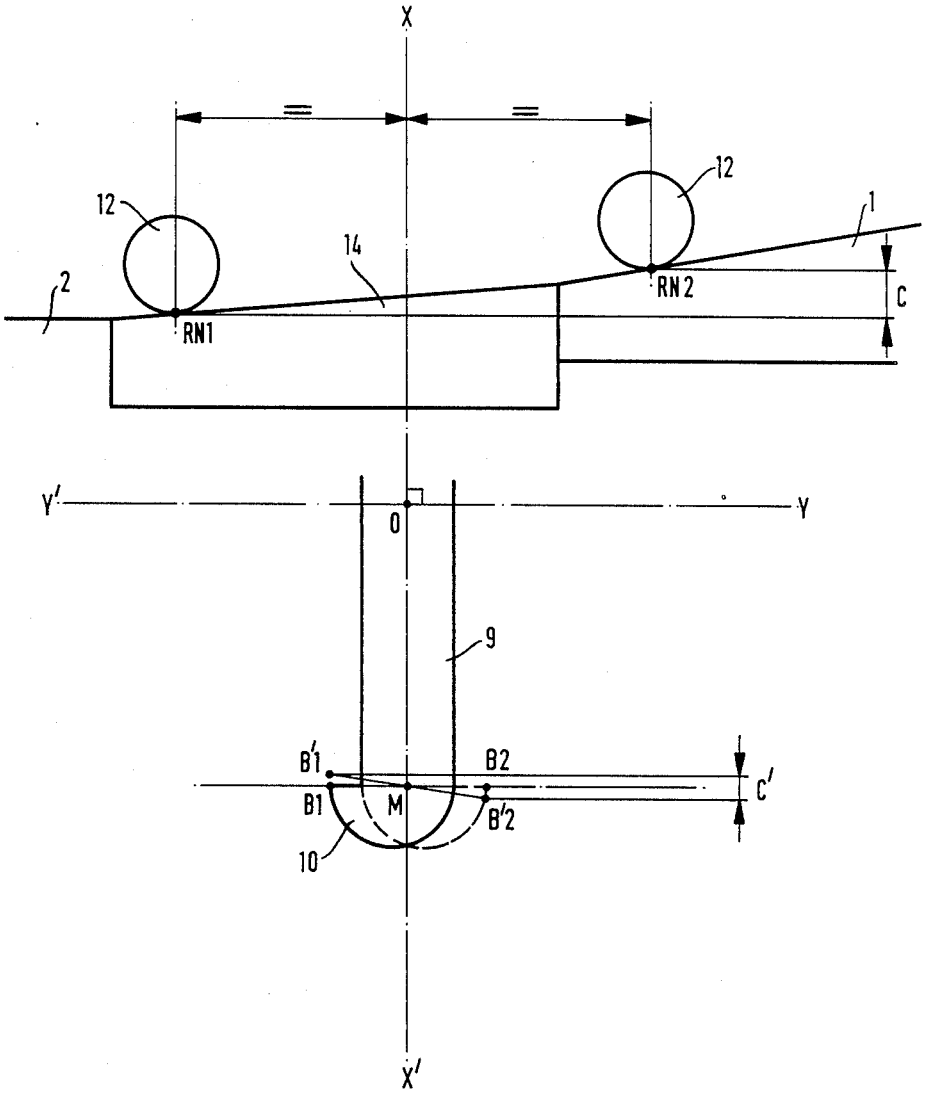
FIG. 9 shows a diagram illustrating the principal of operation of the apparatus which is the objection of the invention.

Referring to the diagram of FIG. 9, one will better understand the principal of double action tightening which the apparatus forming an object of the invention provides.

In the diagram, line XX' shows the pivot axis of the attachment rod 9, while the line YY' shows the displacement axis of the spring head 12 of rod 9.

When the rod 9 is introduced into the anchoring sheath 5, or directly in the bore of cross-tie 2, or further in the tie plate 4, the spring head 12 is in the position RN1 and the heel 10 in the position B1.

By maneuvering rod 9 a half-turn around its axis XX', one brings the spring head 12 to the position RN2 and the heel 10 in the position B2 with a stress equal to C, by virtue of the difference in level between the two positions RN1 and RN2 resulting from the sloping surfaces of shim 14, or tie plate 4 and of shoe 1 of the rail, and by virtue of the passage of heel 10 from the position B1 to the retention position B2.

This stress is reinforced by C if the tensioning means which constitute the shoulder 8 in the anchorage sheath 5, or edge 30 of container 27, or shoulder 35 in the tie plate 4, is inclined along axis B'1—B'2 forming a cam.

One can at leisure increase the tightening effect of spring head 12 on shoe 1 of the rail, by inclining the pivoting axis XX' of rod 9 in a manner so as to render the angle XOY more and more acute.

It is self-evident that modifications of details can be provided to the apparatus which has just been described without going beyond the scope of the invention.

I claim:

1. A securing device, for securing railway rails on cross ties, comprising a rod having a first end and a second end and a longitudinal axis, said first end including a spring head, shaped as an open ring, which is adapted to rest against a rail shoe, said second end including an inclined heel, off-centered from said longitudinal axis, defining a hook which is adapted to cooperate with a hooking surface, and means for progressively tensioning said spring head on the rail shoe, comprising a surface inclined upwardly in the direction of the rail shoe, for guiding said spring head of said rod to a position over the rail shoe as said spring head of said rod is moved by a half-turn around said longitudinal axis.

2. A securing device, for securing railway rails on cross ties, comprising a rod having a first end and a second end and a longitudinal axis, the first end including a spring head, shaped as an open ring which is adapted to rest against a rail shoe, said second end including a heel which is off-centered from the longitudinal axis, defining a hook which is adapted to cooperate with a hooking means, said securing device comprising two functionally operable means for tensioning said spring head on the rail shoe, said two means for tensioning said spring head on the rail shoe comprising:

(a) a first means, including an upper surface which is inclined toward the rail shoe, for exerting a tensioning force on said spring head by rotating said rod by a half-turn, to move said spring head from a first position on said inclined upper surface to a second, higher position, on a portion of the rail shoe; and (b) a second means including an anchoring sheath having a shoulder for cooperating with said heel of said rod when said spring head is maintained in said second position, said shoulder being longitudinally downwardly inclined in the direction of the rail shoe to further exert a tensioning force on said spring head.

3. The securing device of claim 2 wherein said first means includes a shim inclined upwardly in the direction of the rail shoe.

4. The securing device of claim 3, wherein said shim includes an upwardly extending collar with a bore for removably receiving said rod.

5. The securing device of claim 3, including a shoulder having a hollowed out depression including edges, which form anti-return stops for said heel of said rod.

6. The securing device of claim 2 wherein said first means includes a tie plate having a portion inclined upwardly in the direction of the rail shoe.

7. The securing device of claim 6 wherein said first means comprises a tie plate for centering a railway rail, each end of said tie plate having a first orifice with an oblong section adjacent a flange which extends upwardly therefrom, and a second orifice having a circular section through which said rod is adapted to pass, and wherein said anchoring sheath of said second means includes a steel basin adapted to be retained in a facing in said tie plate for centering the railway rail, said steel container having a bore for communicating with said orifices of said tie plate for passage of said rod, said shoulder of said second means being comprised of an edge of said steel container for engagement with said heel of said rod.

8. The securing device of claim 7 including a shoulder inclined downwardly in the direction of the rail shoe for maintaining said heel of said rod, said shoulder functioning as a cam.

9. The securing device of claim 7, including a shoulder having a hollowed out depression including edges, which form anti-return stops for said heel of said rod.

10. The securing device of claim 6 wherein the anchoring sheath is a plastic insertion having a hollow oblong section for the passage and holding said rod.

11. The securing device of claim 2 wherein said anchoring sheath of said second means is a PLASTIRAIL type anchoring sheath.

12. The securing device of claim 2 wherein said means for tensioning includes a tie plate for resting on a cross tie, said second means comprising a shoulder formed in said tie plate for cooperating with said heel of said rod, said tie plate having a top surface and a bottom surface, and including a first orifice extending from said top surface and a second orifice extending from said bottom surface, said second orifice being of a larger section than said first orifice, whereby said shoulder is formed between said orifices for cooperating and hooking said heel of said rod.

13. The device of claim 12, further including a shim adapted to be positioned in said orifices in said tie plate for wedging said rod within said orifices.

14. The device of claim 12 including depressions in said shoulder which act as anti-return stops for the heel of said rod.

15. The securing device of claim 2 wherein said rod is made of steel wire.

16. The securing device of claim 2 wherein said rod is made of reinforced plastic material.

* * * * *

UNITED STATES PATENT AND TRADEMARK OFFICE

CERTIFICATE OF CORRECTION

PATENT NO. : 4,927,078

DATED : May 22, 1990

INVENTOR(S) : Gerard VANOTTI

It is certified that error appears in the above-identified patent and that said Letters Patent is hereby corrected as shown below:

On the title page, the Assignee should be changed from "Etablissements S.A." to ---Etablissements Vape S.A.".

On the patent cover page, the "PCT Pub. Date" should be changed from "Jun. 26, 1988" to ---Jun. 16, 1988---.

Column 1, line 19, change "retension" to ---retention---.

Column 1, line 56, change "rest" to ---rests---.

Column 4, line 33, change "C" to ---C'---.

Signed and Sealed this

Twenty-eighth Day of July, 1992

*Attest:*

DOUGLAS B. COMER

*Attesting Officer*

*Acting Commissioner of Patents and Trademarks*